United States Patent [19]

Kaser et al.

[11] Patent Number: 5,014,990

[45] Date of Patent: May 14, 1991

[54] KICKING TOY

[75] Inventors: Christopher K. Kaser, Chappaqua; Gerald W. Cummings, Wantagh, both of N.Y.

[73] Assignee: Big Ideas Toy and Game Development, Inc., New York, N.Y.

[21] Appl. No.: 461,047

[22] Filed: Jan. 4, 1990

[51] Int. Cl.[5] ..... A63H 27/00; A63B 71/00; A63B 65/02; A63B 65/00

[52] U.S. Cl. ..... 273/128 R; 273/417; 273/428; 446/46

[58] Field of Search ..... 273/55 B, 126 A, 128 R, 273/128 CS, 128 A, 417, 424, 425, 426, 427, 428; 446/34, 36, 46, 47, 48, 429, 430, 473; 272/106, 107

[56] References Cited

U.S. PATENT DOCUMENTS

| | | | |
|---|---|---|---|
| 2,223,091 | 11/1940 | Bresnahan et al. | 272/107 |
| 2,494,929 | 1/1950 | Colaluca | 273/128 R |
| 2,634,982 | 4/1953 | Gaede | 273/424 |
| 3,201,128 | 8/1965 | Palovik | 273/128 X |
| 3,507,498 | 4/1970 | Spencer | 273/128 CS |
| 3,675,928 | 7/1972 | Gentile | 273/128 R |
| 3,759,518 | 9/1973 | Mroz | 273/417 |
| 3,997,164 | 12/1976 | White, Sr. | 273/128 R |
| 4,078,801 | 3/1978 | White, Sr. | 273/128 R |
| 4,334,385 | 6/1982 | Melin et al. | 273/424 X |

FOREIGN PATENT DOCUMENTS

| | | | |
|---|---|---|---|
| 2906776 | 8/1980 | Fed. Rep. of Germany | 273/128 CS |
| 3613523 | 10/1987 | Fed. Rep. of Germany | 273/128 CS |

*Primary Examiner*—Robert A. Hafer
*Assistant Examiner*—D. Neal Muir
*Attorney, Agent, or Firm*—Dressler,Goldsmith,Shore,Sutker & Milnamow, Ltd.

[57] ABSTRACT

A kicking toy is shown which has a generally disc-shaped central body and an annular shock absorber generally encircling the central body. At least one of the expansive surfaces of the central body is concave. The shock absorber has an outer, annular kicking portion, positioned outside of the outer wall of the central body, and an inner, annular retention portion positioned inside of said outer wall. The outer kicking portion has grooves and ribs around the periphery of the kicking region. The inner retention portion and outer kicking portion are integrally joined by a plurality of connector lugs extending therebetween and through circumferentially spaced openings in the outer wall of the central body. An inner wall of the central body is adjacent the inner retention portion of the shock absorber. The central body comprises upper and lower body portions, which have studs and sockets for matching the studs and sockets of the opposing body portions. The upper and lower body portions may be identical.

10 Claims, 2 Drawing Sheets

KICKING TOY

TECHNICAL FIELD

The present invention relates generally to toys, and more particularly to a generally disc-shaped, puck-like kicking toy.

BACKGROUND OF THE INVENTION

Children and adults play a variety of games using a variety of disc-shaped toys including flying saucers, Frisbees, discuses, hockey pucks, etc. These disc-shaped toys take advantage of aerodynamic properties associated with discs. Thus, the flying saucer toy, Frisbee and discus use aerodynamic properties of a disc to travel great distances when thrown in the air with correct spin, trajectory, etc. The hockey puck takes advantage of these aerodynamic properties as well.

Additionally, the hockey puck's disc-shape is advantageous in that it tends to cause the puck to lie flat on ice, and have a smooth sliding action so as to present a stable device for handling with a hockey stick.

However, these disc-shaped toys are not useful for kicking games. Flying saucers, Frisbees and discuses ordinarily do not exhibit the durability required to withstand the stresses of being kicked or handled with a hockey stick. They do not lie flat and slide smoothly and easily on a flat surface. The typical hockey puck is made of hard, dense rubber, but does not slide on non-slippery playing surfaces, such as tile, wood, asphalt, concrete, etc. Therefore, the disc-shaped toys in the prior art are not useful for kicking or hockey games played on non-slippery surfaces.

The disc-shaped kicking toy disclosed herein is distinguished from the disc-shaped toys in the prior art by combining in a unique way the attributes of the disc, a light-weight body, a non-stick material, and a shock absorbing cushion around the periphery of the disc, to form a puck-like kicking toy. Since this toy does not roll like a ball, but rather slides along a smooth, flat surface such as tile, wood, asphalt, concrete, etc., this toy is particularly useful for kicking games, or hockey-like games, played on non-slippery surfaces, in smaller areas, such as interior rooms, or smaller outdoor play areas such as porches, driveways, playgrounds, etc.

SUMMARY OF THE INVENTION

The kicking toy of the present invention is a light-weight disc, with a shock-absorbing perimeter, which is used in playing kicking games, hockey-like games, or the like. Its basic construction is distinguished from the prior art by combining a generally disc-shaped central body with an annular shock-absorption means generally encircling the central body. The shock-absorption means presents an outwardly facing kicking region for contact with a player's foot, hockey stick, etc.

In the illustrated embodiment, the disc-shaped central body defines a generally, upstanding cylindrical peripheral surface, and a pair of generally circular, opposite expansive surfaces between which the cylindrical peripheral surface extends.

There is an annular shock-absorption means generally encircling the central body. This shock-absorption means presents an outwardly facing kicking region for contact with a player's foot, hockey stick, etc., when the toy is on an associated surface with one of its expansive surfaces in generally confronting relationship with the associated surface. At least one of the expansive surfaces of the central body has a generally concave configuration for aerodynamic cooperation with said associated surface during movement of the toy across the associated surface.

The annular shock-absorption means has a plurality of grooves on its periphery, whereby the outwardly facing kicking region is provided with a plurality of resilient ribs for enhancing shockabsorption.

The central body has an outer wall containing a plurality of circumferentially spaced openings. The annular shock-absorption means has an outer, annular kicking portion positioned outside of and adjacent the outer wall of the central body, and an inner, annular retention portion positioned inside of and adjacent the outer wall of the central body. The inner retention portion and the outer kicking portion of the shock-absorption means are integrally joined by a plurality of connector lugs extending between the inner and outer portions through the circumferentially spaced openings in the outer wall of the central body.

The central body may also have an inner wall positioned radially inward of the outer wall. In such a construction, the inner retention portion of the shock-absorption means is positioned between the inner and outer walls of the central body.

The central body is split into upper and lower body portions. One of said upper and lower body portions includes a plurality of studs, and the other of said body portions includes a plurality of sockets for receiving the studs.

The upper and lower portions of the central body are preferably identically configured.

DETAILED DESCRIPTION

Figure 1:
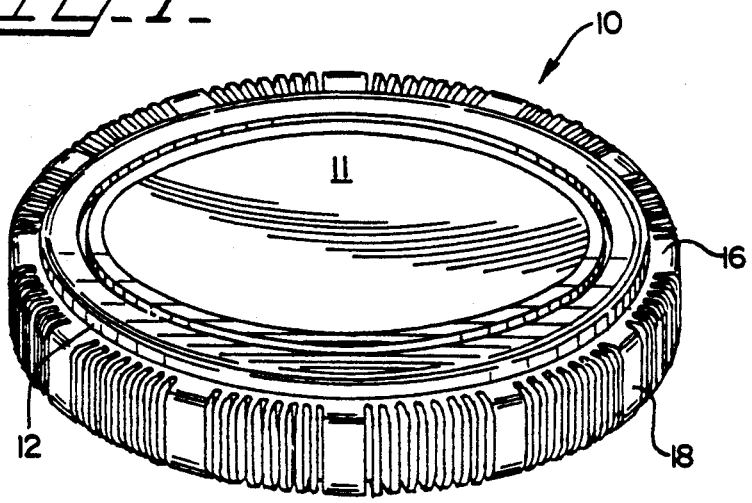
FIG. 1 is a perspective view of a kicking toy embodying the principles of the present invention.

While the present invention may be embodied in various forms, the preferred embodiment is shown in the drawings and described herein, with the understanding that the present disclosure is merely one example of the invention, and is not intended to limit the invention to the example shown.

Figure 2:
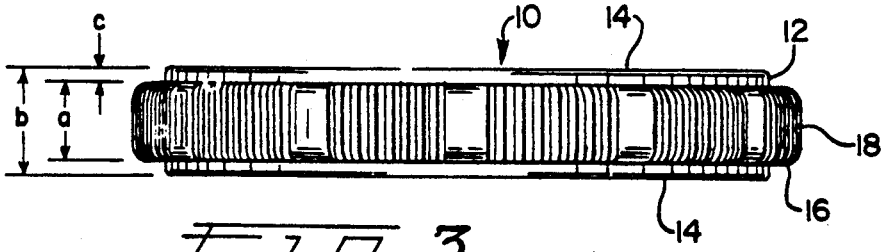
FIG. 2 is a side elevational view of the kicking toy.
Figure 3:
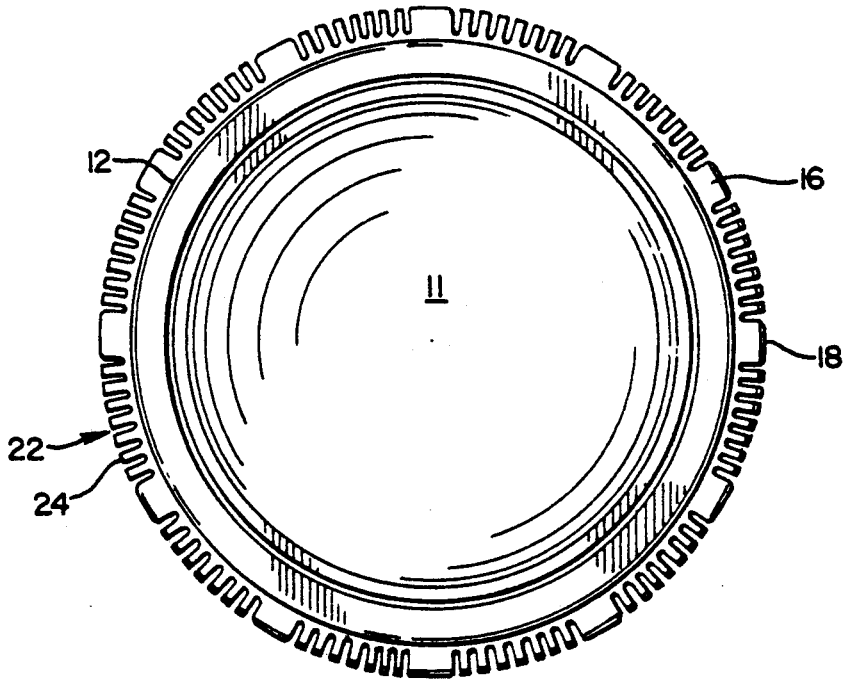
FIG. 3 is a top plan view of the kicking toy.

Referring to FIGS. 1, 2 and 3, the kicking toy 10 comprises a preferably generally disc-shaped central body 11 and an annular shock-absorption means 16 generally encircling the central body.

While the illustrated embodiment of kicking toy 10 is shown as generally disc-shaped, the toy may be otherwise configured while keeping with the principles disclosed herein. For example, the toy may be configured in a polygonal shape, such as triangular, octagonal, and the like, or otherwise shaped, such as like a boomerang. In accordance with the invention, the annular shock-absorption means 16 is arranged to generally encircle the central body 11 of the construction, irrespective of the various shapes in which the toy may be configured.

The central body 11 defines a generally upstanding, cylindrical peripheral surface 12, and a pair of generally circular, opposite expansive surfaces 14. The central body is formed from a rigid plastic, such as polyethylene, or other suitable material which is rigid and can be formed with a smooth, relatively non-stick surface. While the central body may be solid, a generally hollow construction is preferred in order to reduce weight and save material.

Figure 4:
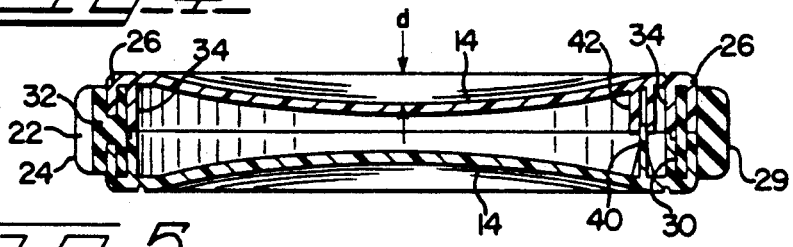
FIG. 4 is a cross-sectional view of the kicking toy.

Referring to FIG. 4, at least one of said expansive surfaces 14 of the central body 11 has a generally concave configuration, emphasized in the dimension "d", for reduced friction and aerodynamic cooperation with an associated surface during movement of the toy across the associated surface. When an expansive surface 14 is in confronting relationship with a flat, associated surface, such as a playing floor, there is an air pocket between the concave expansive surface 14 and the flat associated surface of the floor. The concavity of the expansive surface reduces the area of contact between the expansive surface and the associated surface of the floor. This reduction in area of contact minimizes friction between the kicking toy and the associated surface of the playing floor, and permits easier sliding of the kicking toy along the playing surface.

While not wishing to be bound by any particular theory of operation, it is believed that when the kicking toy is sliding rapidly along an associated surface, the concave configuration of the expansive surface 14 of the central body 11 cooperates aerodynamically with the associated surface. The air pocket between the expansive surface of the central body and the associated surface of the playing floor creates an air cushion effect which further minimizes friction and enhances sliding of the kicking toy along the associated surface.

The annular shock-absorption means 16 encircles the central body 11 and is in juxtaposed relationship with the cylindrical peripheral surface 12 of the central body. The shock-absorbing means 16 presents an outwardly facing kicking region 18 for contact with a player's foot, hockey stick, etc., when the toy is on an associated surface with one of its expansive surfaces 14 in generally confronting relationship with the associated surface.

Referring to FIG. 2, the thickness of the annular shock-absorption means 16 is indicated by the dimension "a." The thickness of the central body 11 is indicated by the dimension "b." When the kicking toy is lying on a flat associated surface, the annular shock-absorption means does not make contact with the associated surface, and is raised above the associated surface as indicated by the dimension "c." This absence of contact minimizes friction between the annular shock-absorption means and the associated surface and enhances movement of the kicking toy over the associated surface.

The annular shock-absorption means is preferably made from a suitably durable elastomeric material, such as polyurethane or the like. However, a variety of other materials will serve the same purposes.

Referring to FIG. 3, the annular shock-absorption means 16 has a plurality of grooves 22 at its periphery. The grooves are located close enough to each other so as to create a plurality of resilient ribs 24 for enhancing shock-absorption in the kicking region 18 around the periphery of the toy. While the drawings show a series of generally vertical grooves 22, the grooves may be oriented diagonally or horizontally (similar to an automobile tire) in order to enhance shock-absorption and grip when the player's foot, hockey stick, etc., makes contact with the kicking region.

The grooves 22 in the kicking region 18 around the periphery of the kicking toy grip the player's foot (or hockey stick, if using the toy for hockey). This grip permits the player to impart a spin on the kicking toy at the time of the kick (or contact with the hockey stick). This spin will permit the kicking toy to maintain a stable, flat, aerodynamic trajectory, similar to a flying saucer, Frisbee or discus, as it slides over the playing surface.

Figure 5:
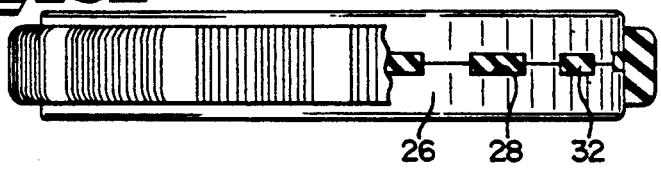
FIG. 5 is a side elevational view, partially cut-away, of the kicking toy.
Figure 6:
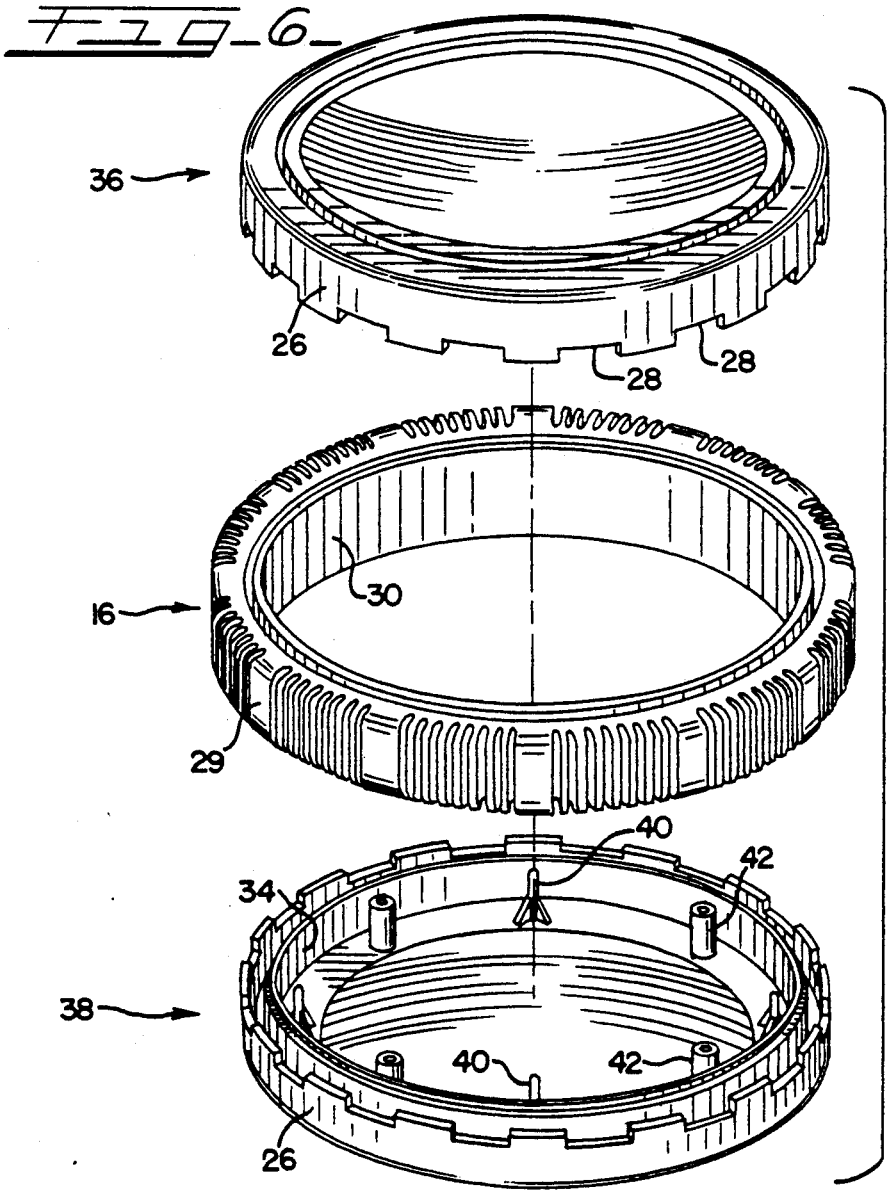
FIG. 6 is an exploded, perspective view of the present kicking toy depicting upper and lower portions of a central body and an annular shockabsorption means.

Referring to FIGS. 4, 5 and 6, the central body 11 has an outer generally cylindrical wall 26 defining the upstanding cylindrical peripheral surface 12. The outer wall 26 has a plurality of circumferentially spaced openings 28. The openings 28 are formed when the upper body portion 36 and lower body portion 38 of the central body 11 are brought together.

The annular shock-absorption means 16 comprises an outer, annular kicking portion 29 which is positioned outside of and adjacent the cylindrical peripheral surface 12 of the outer wall 26 of the central body 11, and an inner, annular retention portion 30 which is positioned inside of and adjacent said outer wall 26. The inner retention portion 30 and the outer kicking portion 29 are integrally joined by a plurality of connector lugs 32 which pass through the openings 28 in the outer wall 26 of the central body. This construction retains and affixes the outer kicking portion of the annular retention means to the outer wall of the central body.

A cylindrical inner wall 34 of the central body 11 is positioned radially inward of the outer wall 26. When the annular shock-absorption means 16 is inserted around the periphery of the central body 11, the inner wall 34 of the central body is positioned inside of and adjacent the retention portion 30 of the shock-absorption means 16. Thus, the retention portion of the shock-absorption means is positioned between the inner wall 34 and the outer wall 26 of the central body 11.

The inner wall 34 adds additional structural support to the central body 11, and reinforces the periphery of the kicking toy which absorbs great stress when the toy is kicked. The inner wall 34 provides an additional guide for location of the inner retention portion 30 of the shock-absorption means 16 between the inner wall 34 and the outer wall 26 of the central body 11 during assembly. Also, the inner wall 34 restrains the inner retention portion 30 from deformation, when significant kicking forces act upon the shock-absorption means and tend to pull the outer kicking portion 29 away from the outer wall 26 of the central body.

As seen from the exploded view in FIG. 6, the central body 11 is formed from an upper body portion 36 and a lower body portion 38 which are joined together during assembly of the kicking toy. This splitting of the central body facilitates easy assembly of the various parts of the kicking toy.

A system of studs 40 and sockets 42 is used to orient and align the upper body portion 36 and the lower body portion 38 so as to form the spaced openings 28 around the outer wall 26 of the central body 11. As seen in FIG. 4, each stud 40 fits inside a respective socket 42. Each body portion has a plurality of studs and/or sockets which fit the studs and/or sockets of the opposing body portion.

The upper body portion 36 and the lower body portion 38 may be identical. Such identicality simplifies manufacture and assembly of the body portions.

This invention is denominated as a kicking toy because it is anticipated that it will be used as a toy for kicking games. However, the toy can be used for a variety of other games, including hockey which is not played on ice.

While the foregoing describes the preferred embodiment of the invention, the spirit and scope of the present invention include numerous modifications and variations of the preferred embodiment. No limitation with respect to the disclosed embodiment is intended or should be inferred. All such modifications and variations are intended to fall within the scope of the claims.

What is claimed is:

1. A kicking toy for use in playing kicking games, comprising:

a central body, said central body defining a generally upstanding, peripheral surface, and a pair of opposite expansive surfaces between which peripheral surface extends, said central body including an outer wall defining said upstanding peripheral surface thereof, and a plurality of spaced openings therein; and an annular shock-absorption means generally encircling said central body and juxtaposed to said peripheral surface of said central body, said shock-absorption means presenting an outwardly facing kicking region for contact with a player's foot when said toy is on an associated surface with one of its expansive surfaces in generally confronting relationship thereto, said annular shock-absorption means comprising an outer, annular kicking portion positioned outside of and adjacent the peripheral surface of said outer wall, and inner retention means positioned inside of and adjacent said outer wall for retaining said shock-absorption means in position on said central body, said inner retention means and said outer kicking portion of said shock-absorption means being integrally joined by a plurality of connector lugs extending therebetween and through said openings defined by said outer wall of said central body.

2. A kicking toy in accordance with claim 1 wherein at least one of said expansive surfaces of said central body has a generally concave configuration for aerodynamic cooperation with said associated surface during movement of said toy thereacross.

3. A kicking toy in accordance with claim 1 wherein said annular shock-absorption means defines a plurality of grooves at the periphery thereof, whereby said outwardly facing kicking region is provided with a plurality of resilient ribs for enhancing shockabsorption.

4. A kicking toy in accordance with claim 1, wherein the thickness of said annular shock-absorption means is less than the thickness of said central body.

5. A kicking toy according to claim 1, wherein said central body further includes an inner wall positioned inwardly of said outer wall, said retention portion of said shock-absorption means being positioned between said inner and outer walls of said central body.

6. A kicking toy according to claim 1, wherein said central body comprises upper and lower body portions which are joined to form said central body.

7. A kicking toy according to claim 6, wherein one of said upper and lower body portions includes a plurality of studs and the other of said body portions includes a plurality of sockets for receiving said studs for joining said body portions to each other.

8. A kicking toy in accordance with claim 7, wherein said upper and lower portions are identically configured.

9. A kicking toy according to claim 1, wherein said central body is of a generally circular disc shape, and said peripheral surface is generally cylindrical, and said shock-absorption means is generally circular.

10. A kicking toy in accordance to claim 1, wherein said inner retention means comprises an inner, annular retention portion positioned inside of and adjacent said outer wall.

* * * * *